US007559094B2

(12) United States Patent
Solari

(10) Patent No.: US 7,559,094 B2
(45) Date of Patent: Jul. 14, 2009

(54) VENTILATED ADJUSTABLE CAP

(76) Inventor: Ray Solari, 531 Main St., Suite 1105, El Segundo, CA (US) 90245

( * ) Notice: Subject to any disclaimer, the term of this patent is extended or adjusted under 35 U.S.C. 154(b) by 0 days.

(21) Appl. No.: 11/651,391

(22) Filed: Jan. 9, 2007

(65) Prior Publication Data

US 2008/0163406 A1 Jul. 10, 2008

(51) Int. Cl.
*A42C 5/00* (2006.01)

(52) U.S. Cl. ..... 2/181; 2/182.4

(58) Field of Classification Search ..... 2/181.2, 2/181.6, 181.8, 182.3, 182.4, 181, 171.1, 2/171.4, 183, 209.3, 209.4
See application file for complete search history.

(56) References Cited

U.S. PATENT DOCUMENTS 1,207,137 A * 12/1916 Clore ..... 2/181.8
RE17,064 E * 8/1928 Fischer ..... 2/183
4,023,212 A * 5/1977 Huffman ..... 2/195.2
5,887,287 A * 3/1999 Potochnik ..... 2/209.13
6,199,214 B1 * 3/2001 Campbell ..... 2/181.6
7,028,344 B2 * 4/2006 Toth ..... 2/413

* cited by examiner

*Primary Examiner*—Katherine Moran
(74) *Attorney, Agent, or Firm*—Trojan Law Offices

(57) ABSTRACT

A ventilated adjustable cap for wearing on a user's head, the cap having a crown and a perimeter band surrounding a circumferential edge of the crown. The perimeter band has a forehead offset, which projects from the remainder of the perimeter band such that the forehead offset generally does not contact the user's forehead. The forehead offset promotes evaporative cooling of the user's head by permitting ambient air to pass between the user's head and the ventilated adjustable cap. The cooling may be further aided by a perforated air passage at the front side of the crown and by one or more water-retentive members. The cap may further have a torsion spring, an elastic band, or both to span at least one edge gap in the circumferential edge of the crown, opposing widening of the edge gap in the direction of the circumferential edge and help to fit the cap snugly on the user's head.

4 Claims, 7 Drawing Sheets

VENTILATED ADJUSTABLE CAP

TECHNICAL FIELD

This invention relates to headwear, particularly a cap, which is ventilated and adjustable.

BACKGROUND ART

Traditional cap designs are often poorly ventilated. Even with mesh in the crown, the wearer's head is still likely to become uncomfortably warm. What is needed is a cap design to promote evaporative cooling of the user's head. Furthermore, traditional cap designs often require an adjustment strap to permit the cap to be used by wearers having different head sizes. What is needed is an adjustable cap that can be slipped on and off, yet proved a snug fit for a variety of wearer head sizes.

DISCLOSURE OF INVENTION

The present invention is directed to a ventilated adjustable cap for wearing on a user's head. The cap promotes evaporative cooling and is easily adjustable for a snug fit on a variety of wearer head sizes. The cap has a crown and a perimeter band surrounding a circumferential edge of the crown. The perimeter band has a forehead offset, which projects from the remainder of the perimeter band such that, during normal use, the forehead offset generally does not contact the user's forehead. The forehead offset promotes evaporative cooling of the user's forehead by permitting ambient air to pass between the user's forehead and the ventilated adjustable cap. The cooling may be further aided by a perforated air passage at the front side of the crown, and the cap may also have one or more water-retentive members to aid cooling. The cap may further have a torsion spring, an elastic band, or both to span at least one edge gap in the circumferential edge of the crown and to oppose widening of the edge gap in the direction of the circumferential edge and help to fit the cap snugly on the user's head.

BEST MODE FOR CARRYING OUT THE INVENTION

Figure 1:
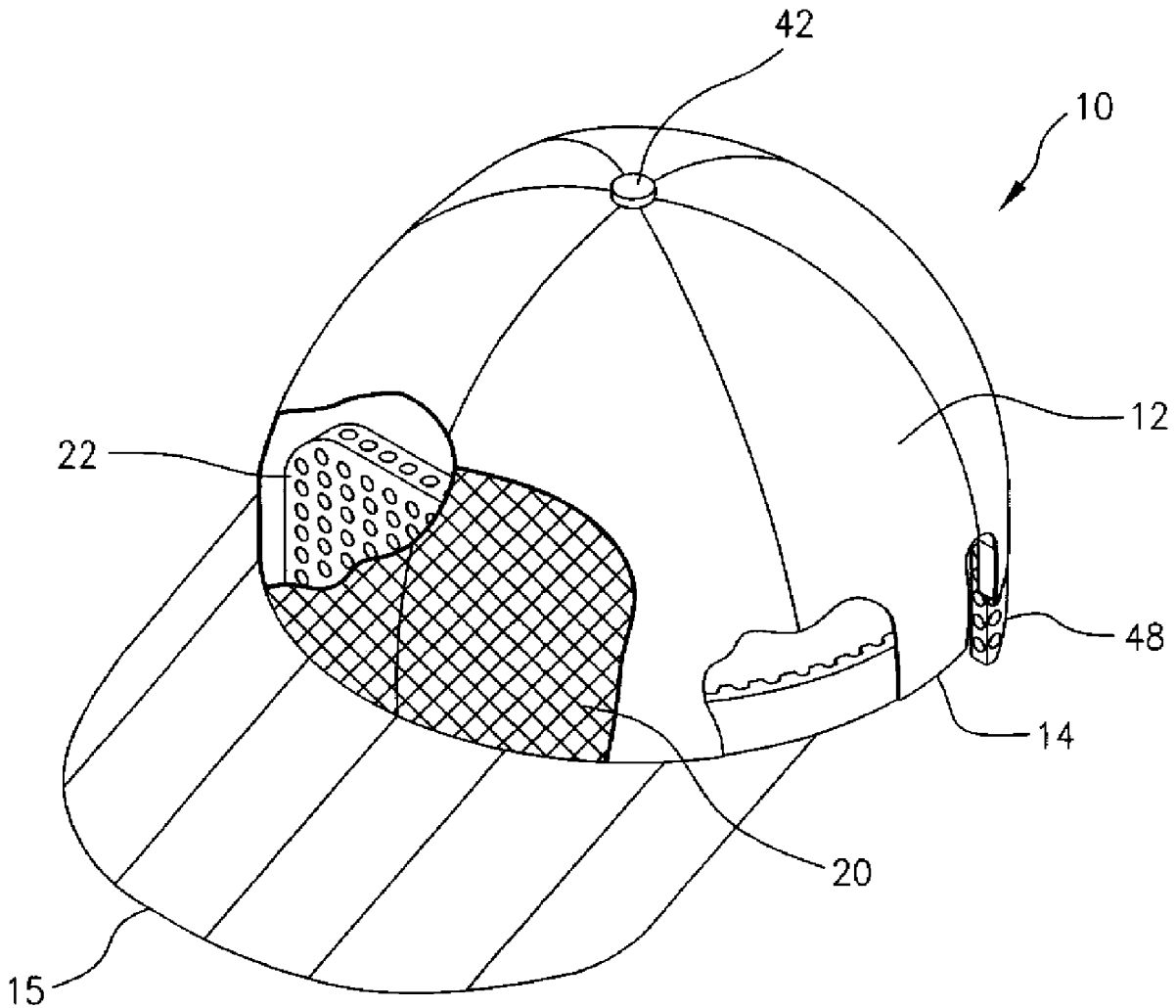
FIG. 1 is a front perspective view of an embodiment of a ventilated adjustable cap with a partial cutaway showing a version of a forehead water-retentive member and a partial cutaway showing a version of corrugations on a circumferential edge of the cap.
Figure 2:
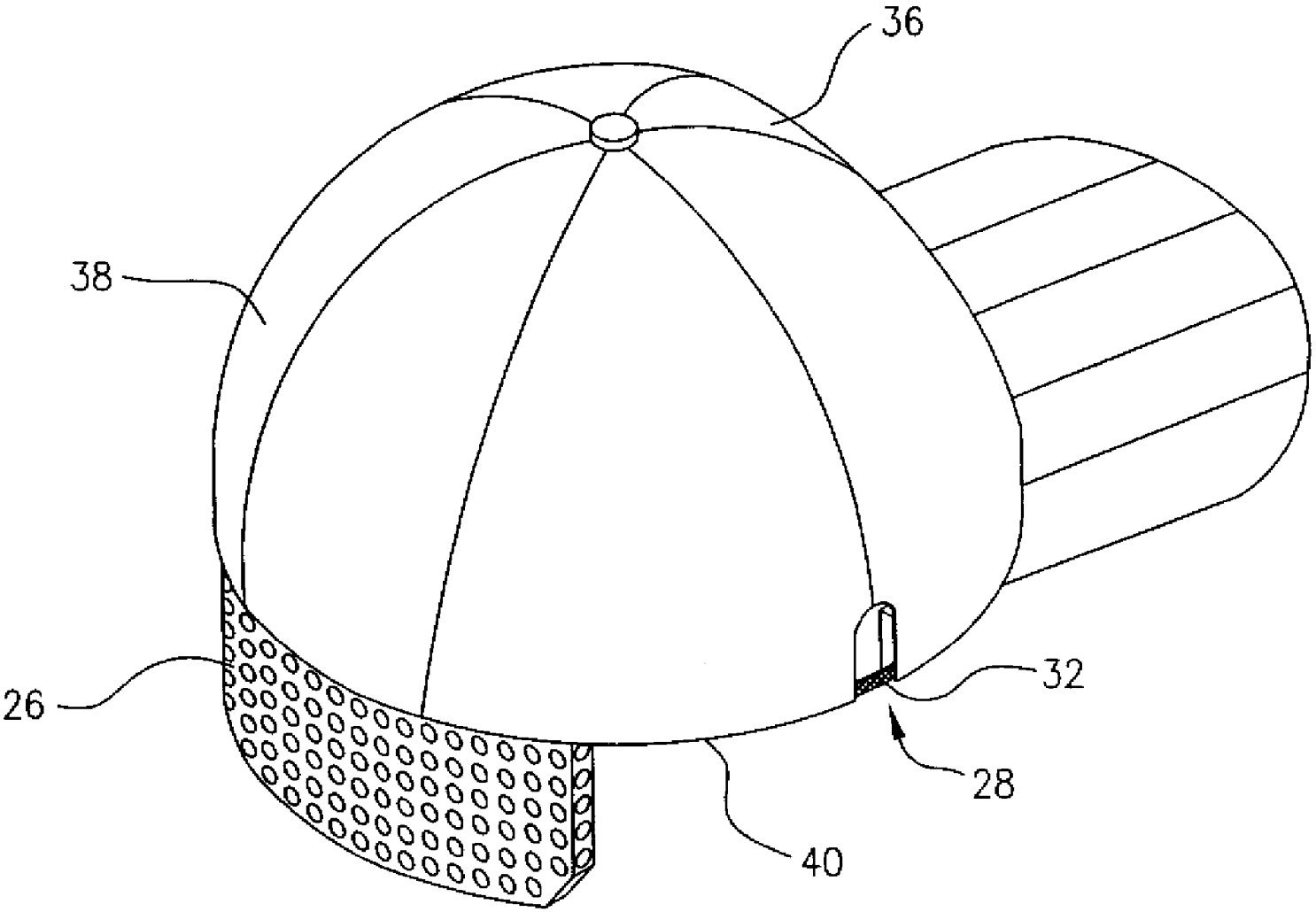
FIG. 2 is a rear perspective view of an embodiment of a ventilated adjustable cap.
Figure 3:
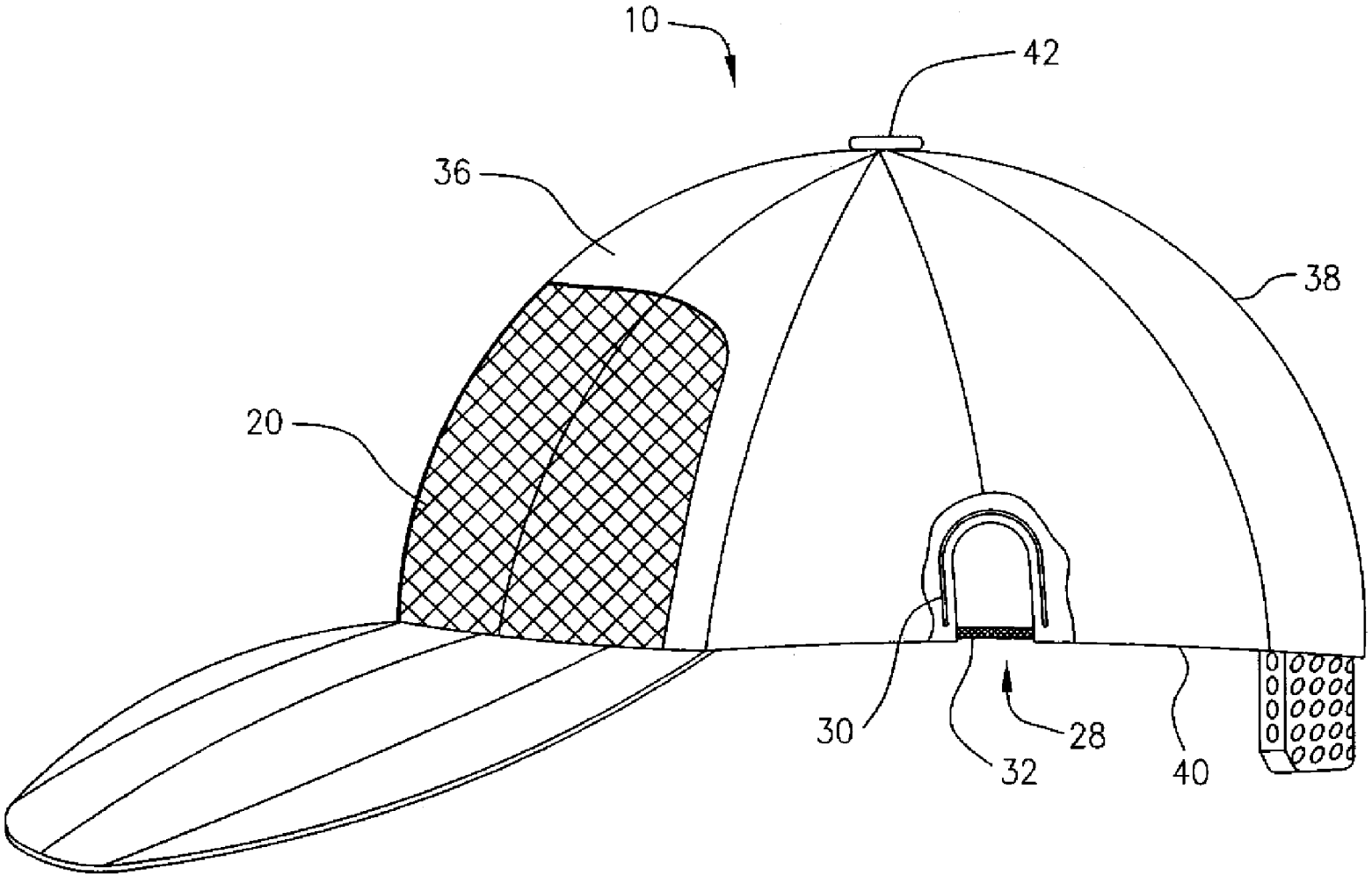
FIG. 3 is a side view of an embodiment of a ventilated adjustable cap with a partial cutaway showing a version of a torsion spring enclosed in the material of the circumferential edge of the cap.

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Referring to the figures, the present invention is directed to a ventilated adjustable cap 10 for wearing on a user's head. The ventilated adjustable cap 10 has a crown 12 and a perimeter band 14 surrounding a circumferential edge 40 of the crown 12. The perimeter band 14 has a forehead offset 44, which projects from the remainder of the perimeter band 14 such that, during normal use, the forehead offset 44 generally does not contact the user's forehead. In some embodiments, the ventilated adjustable cap 10 may also have a brim 15, but a brim is generally not required for successful use of the ventilated adjustable cap 10.

The crown 12 has a front side 36, a back side 38, a circumferential edge 40, and an apex 42. During normal use, the front side 36 of the crown 12 is toward a user's forehead and the back side 38 is toward the back of the user's head.

Figure 4:
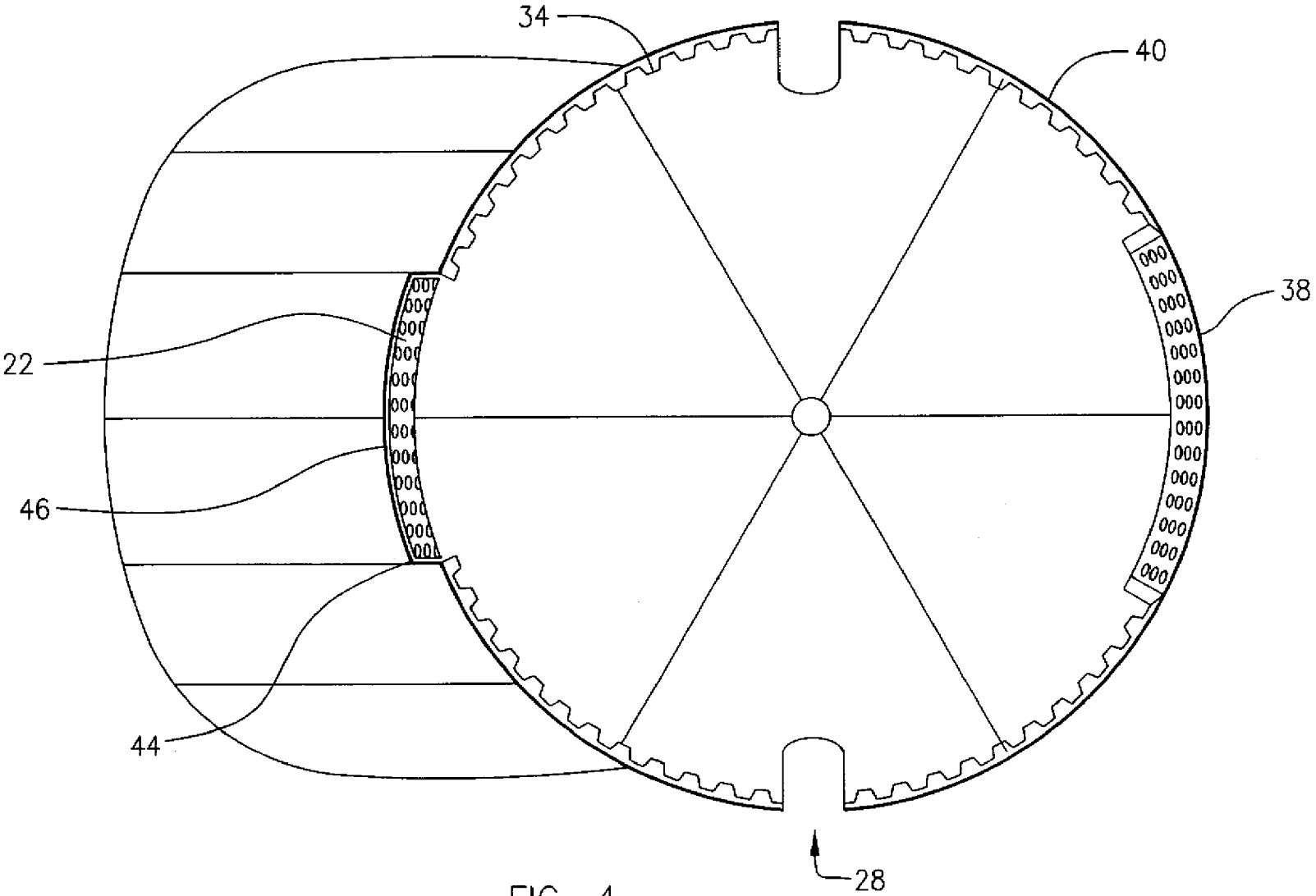
FIG. 4 is a bottom view of an embodiment of a ventilated adjustable cap depicting a version of the stepwise-jut style of the forehead offset.
Figure 5:
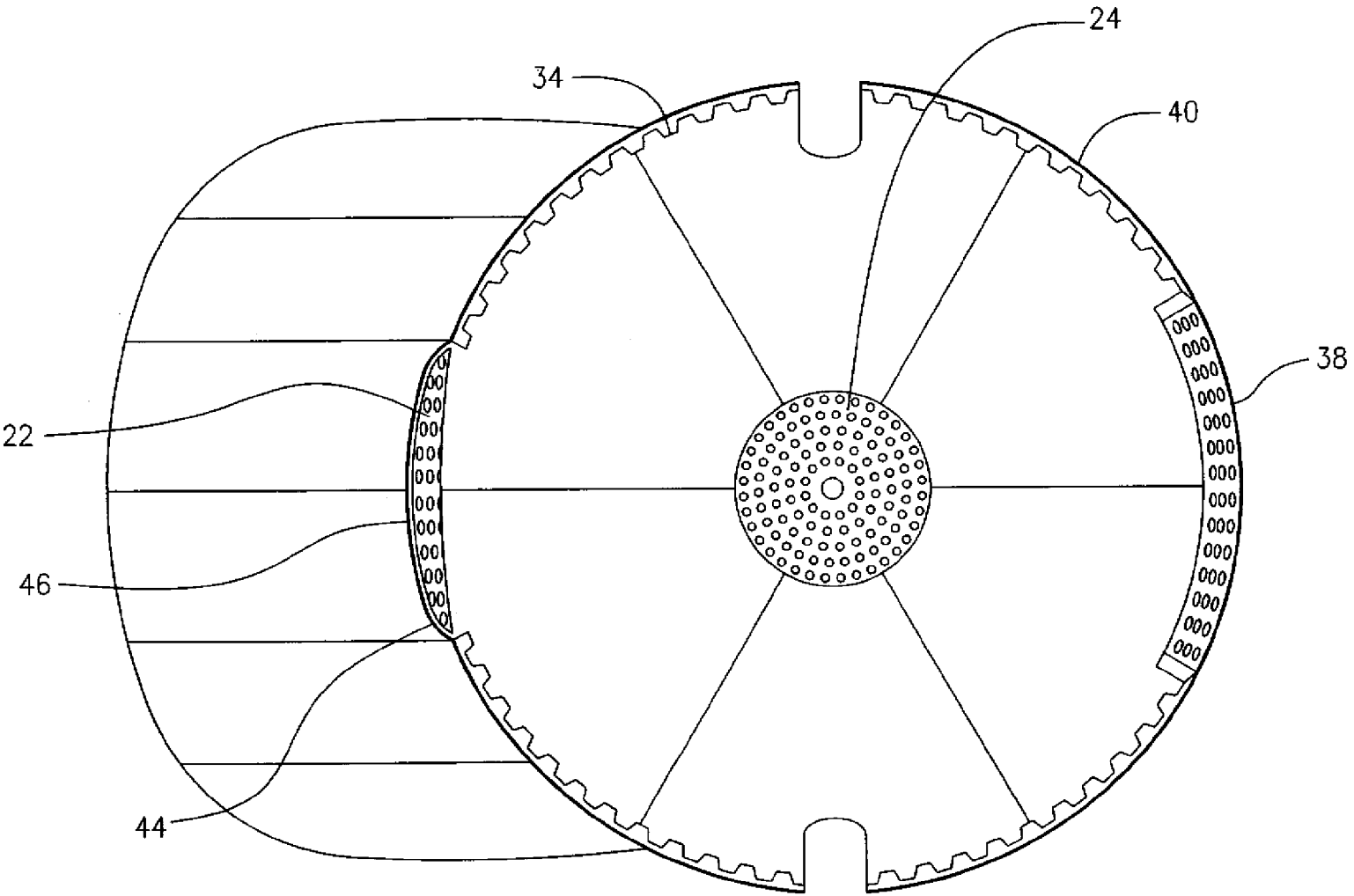
FIG. 5 is a bottom view of an embodiment of a ventilated adjustable cap depicting a version of the change-in-curvature style of the forehead offset.
Figure 6:
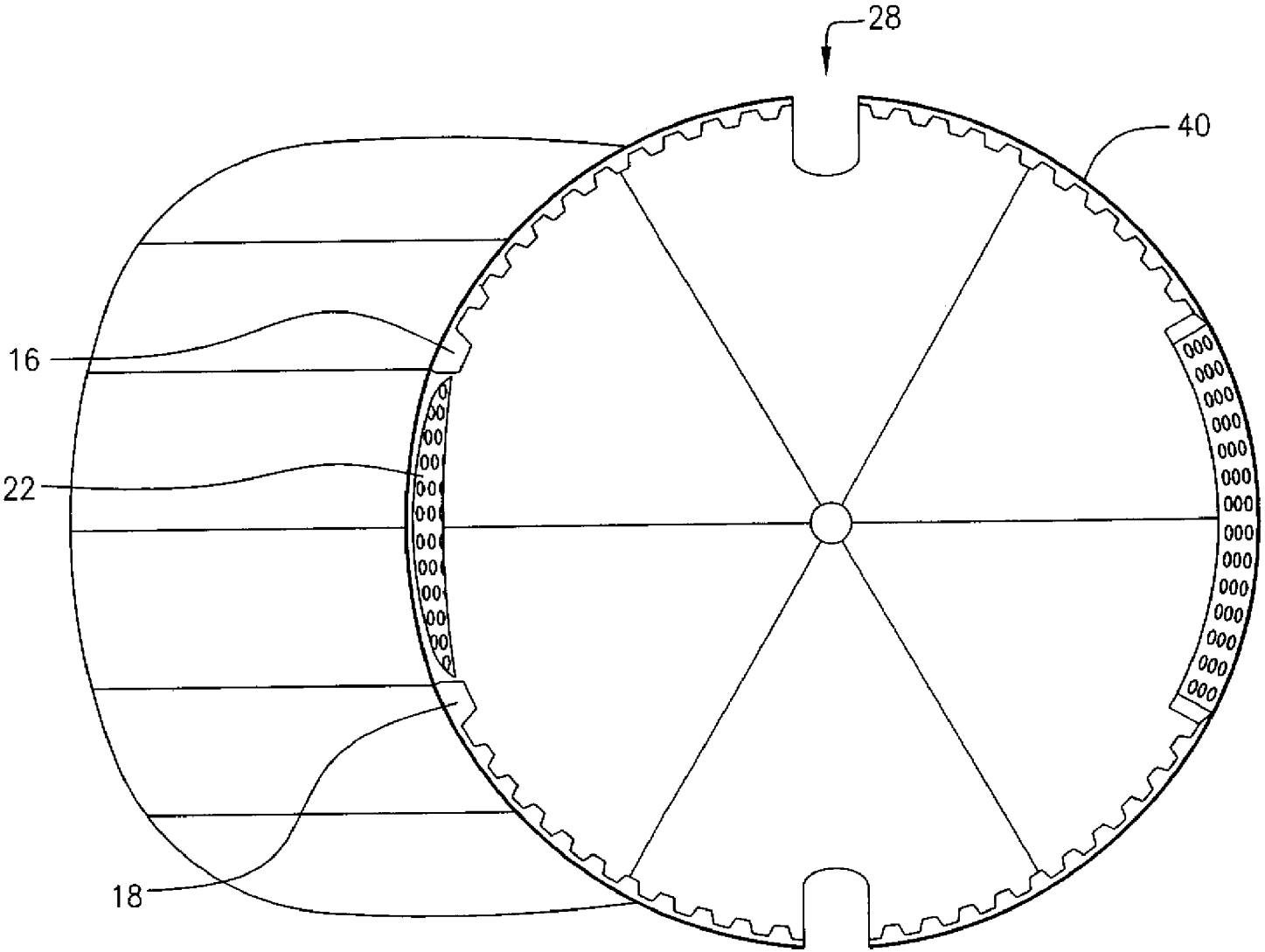
FIG. 6 is a bottom view of an embodiment of a ventilated adjustable cap depicting a version of the temple-pad style of the forehead offset.
Figure 7C:
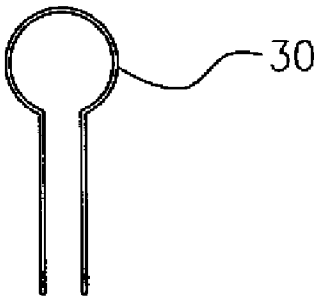
FIG. 7 depicts versions of a torsion spring for some embodiments of a ventilated adjustable cap.
Figure 7B:
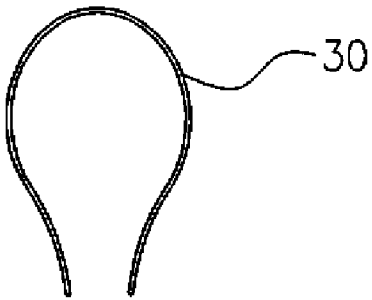
Figure 7A:
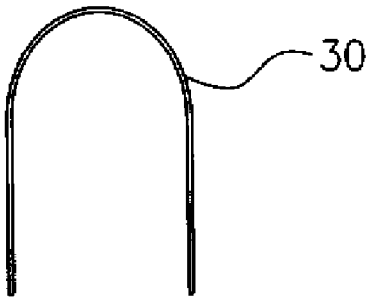
Figure 7F:
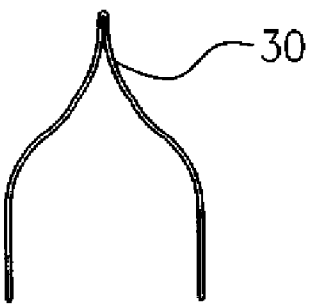
Figure 7E:
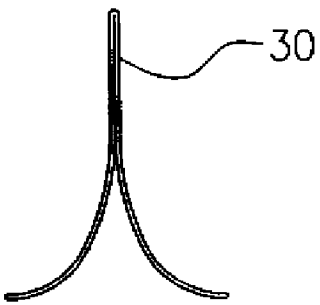
Figure 7D:
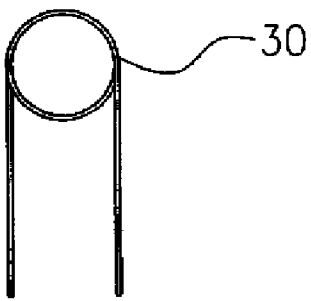

The forehead offset 44 is generally at the front side 36 of the crown 12. The projection of the forehead offset 44 may be the result of a change in curvature of the circumferential edge 40 (an example of which is depicted in FIG. 5) or a stepwise jut in the circumferential edge 40 (an example of which is depicted in FIG. 4) in the region of the forehead offset 44. While it is equally contemplated that the offset can be located other than at the front side 36 of the crown 12, it is preferred that the forehead offset 44 be located at the front side 36 to promote evaporative cooling of the user's forehead. As the forehead offset 44 is generally adjacent to a user's forehead when the ventilated adjustable cap 10 is worn on the user's head, the forehead offset 44 promotes evaporative cooling of the user's forehead by permitting ambient air to pass between the user's forehead and the ventilated adjustable cap 10. In a version of the invention, the forehead offset 44 defines a forehead cavity 46.

An embodiment of the invention includes a left temple pad 16 and a right temple pad 18. The left temple pad 16 is on the perimeter band 14 immediately to the left of the forehead offset 44. Similarly, the right temple pad is on the perimeter band 14 immediately to the right of the forehead offset 44. In this description, left and right refer to the user's left and right when the ventilated adjustable cap 10 is worn on the user's head during normal use, that is, with the front side 36 of the ventilated adjustable cap 10 toward the user's forehead. The left temple pad 16 and right temple pad 18 each contact the user's head and push an adjacent portion of the perimeter band 14 away from the user's forehead. In a version of the invention, the ventilated adjustable cap 10 need not have a forehead offset 44. In such versions, the left temple pad 16 and right temple pad 18 are sufficient to generally keep the perimeter band 14 from contacting the user's forehead. It is noted that the left temple pad 16 and a right temple pad 18 may not be located adjacent the user's temples. That is, the left temple pad 16 and a right temple pad 18 each might contact the user's forehead instead of the user's temples, thereby providing a passage for ambient air to flow between the cap 10 and the user's forehead for cooling of the user's head.

An embodiment of the invention includes at least one perforated air passage 20. The perforated air passage 20 generally has an arrangement of holes through the crown 12. In an embodiment, the perforated air passage 20 is formed from a reticulated, or mesh, material. The perforated air passage 20 may be located at the front side 36 of the crown 12 to provide ventilation to the user's head adjacent the front side 36 of the crown 12, and it may be located at other locations on the crown 12 to promote ventilation of other portions of the user's head.

An embodiment of the invention includes a forehead water-retentive member 22. The forehead water-retentive member 22 may be a porous, absorptive material, capable of absorbing liquids such as water. The forehead water-retentive member 22 may be located in the forehead cavity 46, and it may be connected to the crown 12. The connection may be removable, such as by snap or by a hook and loop fastener, or the connection may be non-removable such as by sewing. However, a removable connection is preferred to permit the forehead water-retentive member 22 to be dipped in water and replaced in the cap 10. As such, the forehead water-retentive member 22 may contain water and allow ambient air to pass through or circulate over it to provide evaporative cooling for the wearer's forehead region. For additional cooling benefits, the forehead water-retentive member 22 may be adjacent to the perforated air passage 20.

An embodiment of the invention includes a crown water-retentive member 24. The crown water-retentive member 24 may be a porous, absorptive material, capable of absorbing liquids such as water. The crown water-retentive member 24 may be located at the apex 42 of the crown 12, and it may be connected to the crown 12. The connection may be removable, such as by snap or by a hook and loop fastener, or the connection may be non-removable such as by sewing. However, a removable connection is preferred to permit the crown water-retentive member 24 to be dipped in water and replaced in the cap 10. As such, the crown water-retentive member 24 may contain water and allow ambient air to pass through or circulate over it to provide evaporative cooling for the top of the wearer's head. For additional cooling benefits, the crown water-retentive member 24 may be adjacent to the perforated air passage 20.

An embodiment of the invention includes a neck flap 48. A neck flap 48 may be connected to the circumferential edge 40 at the back side 38 of the crown 12. The neck flap 48 may have a neck flap water-retentive member 26, which may be a porous, absorptive material, capable of absorbing liquids such as water. The neck flap 48 may be connected to the crown 12. The connection may be removable, such as by snap or by a hook and loop fastener, or the connection may be non-removable such as by sewing. However, a removable connection is preferred to permit the neck flap water-retentive member 26, where present, to be dipped in water and reattached to the cap 10. As such, the neck flap water-retentive member 26 may contain water and allow ambient air to pass through or circulate over it to provide evaporative cooling for the wearer's neck region.

An embodiment of the invention includes an edge gap 28. The edge gap 28 is generally a discontinuity in the circumferential edge 40 and may be an inverted U- or V-shape. The edge gap 28 permits the circumferential edge 40 to widen and narrow to accommodate users having different head sizes. Preferably, there are two edge gaps 28, one at each lateral side of the ventilated adjustable cap 10, near each of the user's ears.

An embodiment of the invention includes a torsion spring 30. The torsion spring 30 circumvents the edge gap 28 and opposes widening of the edge gap 28 in the direction of the circumferential edge 40. Preferably, the torsion spring 30 is enclosed in the material of the circumferential edge 40 to prevent the torsion spring 30 from catching in the user's hair. The torsion spring 30 may be a length of wire, particularly spring steel, having an approximately 180 degree bend, such that the two free ends of the length of wire are generally parallel, with a free end on either side of the edge gap 28 and the bend being in a direction generally away from the circumferential edge 40. It is also envisioned that the torsion spring 30 have an approximately 540 degree bend or a 900 degree bend, such that the torsion spring 30 has a single or a double loop, respectively, with the free ends being generally parallel to each other. The torsion spring 30, however, may have any number of loops to provide appropriate tension in the circumferential edge as described below. Furthermore, the torsion spring 30 need not be a "torsion" spring per se, in that it need not generate any twisting or rotational force provided the torsion spring 30 performs the functions set forth here. For example, the torsion spring 30 could be two arcuate springy members connected at one end and having their radial surfaces contacting. Examples of some torsion spring shapes are given in FIG. 5. It is noted that not all versions of the torsion spring 30 require the free ends to be parallel.

The torsion spring 30 helps the ventilated adjustable cap 10 to fit snugly on the user's head by creating tension in the circumferential edge 40. The tension is strong enough to keep the circumferential edge 40 snug against the user's head, yet weak enough to permit the circumferential edge 40 to expand in diameter to permit users having a larger head to comfortably wear the cap 10. In a version of the invention, the torsion spring 30 provides tension in the circumferential edge 40 without an edge gap 28. In such embodiments, the torsion spring 30 may fit into one or more pockets in the circumferential edge 40, the circumferential edge 40 having sufficient slack to permit expansion and contraction of its overall circumference to permit users of various head sizes to comfortably wear the cap 10. However, embodiments having an edge gap 28 are generally preferred since the edge gap 28 is useful to avoid bunching of the circumferential edge 40. The edge gap 28 may also permit a wider variation in the available circumference of the circumferential edge 40 than in embodiments not having an edge gap 28.

An embodiment of the invention includes an elastic band 32. The elastic band, strip, or patch 32 spans the edge gap 28, either alone or along with the torsion spring 30. The elastic band 32 may be any resilient member to oppose opening of the edge gap 28. As with the torsion spring 30, the elastic band 32 helps the ventilated adjustable cap 10 to fit snugly on the user's head by creating tension in the circumferential edge 40. The tension is strong enough to keep the circumferential edge 40 snug against the user's head, yet weak enough to permit the circumferential edge 40 to expand in diameter to permit users having a larger head to comfortably wear the cap 10. Although edge gap 28 is not required for the elastic band 32 to be effective, embodiments having an edge gap 28 are generally preferred since the edge gap 28 is useful to avoid bunching of the circumferential edge 40.

In a version of the invention, at least a portion of the circumferential edge 40 has corrugations 34. The corrugations 34 may be ridges or a series of protrusions on the circumferential edge 40. The corrugations 34 create air passages between the user's head and the circumferential edge 40 and permit ambient air to flow past the circumferential edge 40 to cool the wearer. The corrugations 34 may be around the entire circumferential edge 40, or they may be on one or more portions of the circumferential edge 40.

While the present invention has been described with regards to particular embodiments, it is recognized that additional variations of the present invention may be devised without departing from the inventive concept.

INDUSTRIAL APPLICABILITY

This invention may be applied to the development, manufacture, and use of headwear, particularly caps, which are ventilated and adjustable.

What is claimed is:

1. A ventilated adjustable cap for wearing on a user's head, the cap comprising:

(a) a crown, the crown having a front side, a back side, a circumferential edge, and an apex, during normal use the front side of the crown being toward a user's forehead;

(b) a perimeter band surrounding the circumferential edge of the crown, the perimeter band having a forehead offset, the forehead offset projecting from the remainder of the perimeter band such that, during normal use, the forehead offset generally does not contact the user's forehead, a space between the user's forehead and the forehead offset defining a forehead cavity;

(c) a left temple pad and a right temple pad, the left temple pad being on the perimeter band immediately to the left of the forehead offset, the right temple pad being on the perimeter band immediately to the right of the forehead offset, where left and right refer to the user's left and right when the cap is worn on the user's head during normal use;

(d) a perforated air passage at the front side of the crown, the perforated air passage providing ventilation to the user's head adjacent the front side of the crown;

(e) a forehead water-retentive member, the forehead water-retentive member comprising a porous, absorptive material, the forehead water-retentive member being located in the forehead cavity, the forehead water-retentive member being removably connected to the crown;

(f) a crown water-retentive member, the crown water-retentive member comprising a porous, absorptive material, the crown water-retentive member being located at the apex of the crown, the crown water-retentive member being removably connected to the crown;

(g) a neck flap connected to the circumferential edge at the back side of the crown, the neck flap comprising a neck flap water-retentive member, the neck flap water-retentive member comprising a porous, absorptive material, the neck flap being removably connected to the crown;

(h) an edge gap in the circumferential edge, the edge gap comprising a discontinuity within the circumferential edge;

(i) a torsion spring circumventing the edge gap, the torsion spring opposing widening of the edge gap in the direction of the circumferential edge;

(j) an elastic band spanning the edge gap; and (k) corrugations on at least a portion of the circumferential edge, the corrugations permitting ambient air to flow between the circumferential edge and the user's head to cool the user;

wherein the forehead water-retentive member, the crown water-retentive member, and the neck flap water-retentive member may contain water and allow ambient air to pass through or circulate over each to provide evaporative cooling for the user;

and wherein the combination of the edge gap, the torsion spring, and the elastic band help to fit the cap snugly on the user's head.

2. A ventilated cap for wearing on a user's head, the cap comprising:

(a) a crown, the crown having a front side, a back side, a circumferential edge, and an apex, during normal use the front side of the crown being toward a user's forehead;

(b) a perimeter band surrounding the circumferential edge of the crown, the perimeter band having a forehead offset, the forehead offset projecting from the remainder of the perimeter band such that, during normal use, the forehead offset generally does not contact the user's forehead;

(c) an edge gap in the circumferential edge; and (d) a spring circumventing the edge gap, the spring opposing widening of the edge gap in the direction of the circumferential edge.

3. The cap of claim 2, the cap further comprising an elastic band spanning the edge gap.

4. An adjustable cap for wearing on a user's head, the cap comprising:

(a) a crown, the crown having a circumferential edge; and (b) a spring in the circumferential edge, the spring creating tension in the circumferential edge to permit the adjustable cap to fit snugly on the user's head; and (c) an edge gap in the circumferential edge, the spring circumventing the edge gap, the spring opposing widening of the edge gap in the direction of the circumferential edge;

(d) wherein the spring comprises a wire having a bend, a first free end, and a second free end, the first free end being generally parallel to the second free end, the first free end being on a first side of the edge gap, the second free end being on a second side of the edge gap, and the bend being in a direction generally away from the circumferential edge.

* * * * *